US011389944B1

(12) United States Patent
Wang

(10) Patent No.: US 11,389,944 B1
(45) Date of Patent: Jul. 19, 2022

(54) TOOL RACK STRUCTURE

(71) Applicant: Jen-Li Wang, Taichung (TW)

(72) Inventor: Jen-Li Wang, Taichung (TW)

( * ) Notice: Subject to any disclaimer, the term of this patent is extended or adjusted under 35 U.S.C. 154(b) by 0 days.

(21) Appl. No.: 17/375,058

(22) Filed: Jul. 14, 2021

(51) Int. Cl.
*B25H 3/00* (2006.01)
*B25H 3/04* (2006.01)

(52) U.S. Cl.
CPC ..... *B25H 3/04* (2013.01); *B25H 3/003* (2013.01)

(58) Field of Classification Search
CPC ..... B25H 3/003; B25H 3/04; B25H 3/06
USPC ..... 206/378
See application file for complete search history.

(56) References Cited

U.S. PATENT DOCUMENTS 5,313,181 A 5/1994 Negus
6,039,188 A * 3/2000 Lee ..... B25H 3/04 206/758
8,408,388 B1 * 4/2013 Chen ..... B65D 25/103 206/45.24
8,469,190 B1 * 6/2013 Chang ..... B25H 3/003 206/375
8,556,075 B1 * 10/2013 Ou ..... B65D 73/0064 206/378
9,126,739 B2 * 9/2015 Chao-Ming ..... B65D 85/02
9,180,590 B1 * 11/2015 Ou ..... B65D 71/00
9,434,065 B2 * 9/2016 Ou ..... B25H 3/003
9,573,270 B2 * 2/2017 Ou ..... B25H 3/003
9,630,313 B2 * 4/2017 Ou ..... B25H 3/003
2015/0183573 A1 * 7/2015 Chao-Ming ..... B25H 3/003 206/378
2016/0107306 A1 * 4/2016 Ou ..... B25H 3/003 206/349
2016/0107307 A1 * 4/2016 Ou ..... B25H 3/04 206/349

* cited by examiner

*Primary Examiner* — Kimberley S Wright
(74) *Attorney, Agent, or Firm* — Karin L. Williams; Alan D. Kamrath; Mayer & Williams PC

(57) ABSTRACT

A tool rack structure includes a first body, and a second body pivotally connected with the first body and rotatable relative to the first body. The first body has an end provided with at least one first pivot portion. The at least one first pivot portion is provided with two first locking portions, a second locking portion, and a third locking portion. The second body is provided with at least one third pivot portion pivotally connected with the at least one first pivot portion. The at least one third pivot portion is provided with two fourth locking portions locked onto the two first locking portions, and a fifth locking portion locked onto the third locking portion.

8 Claims, 11 Drawing Sheets

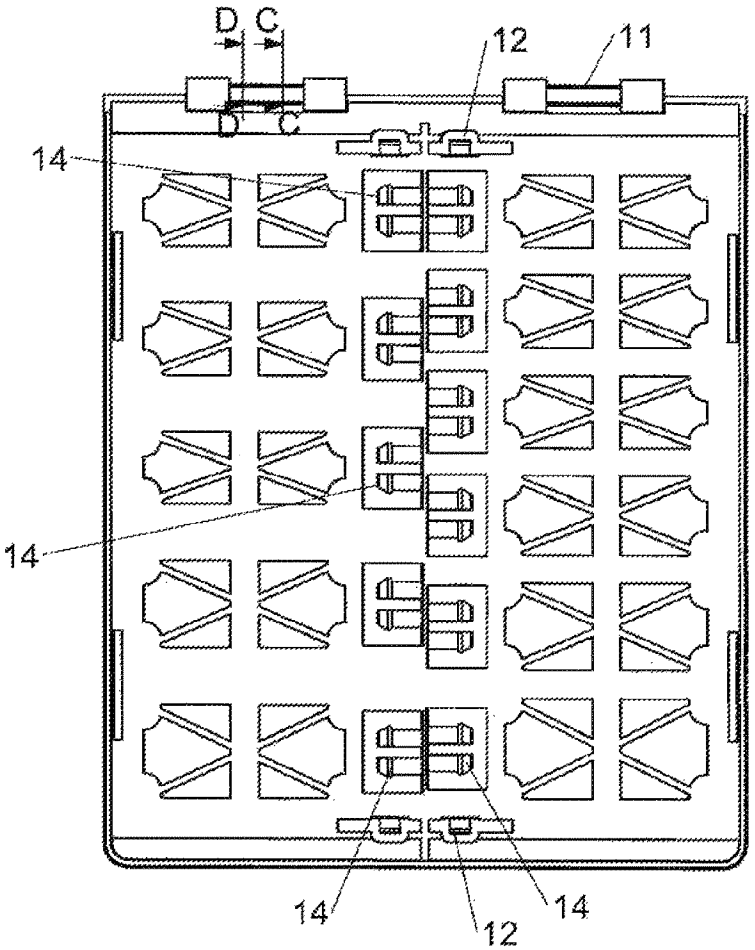
FIG 4
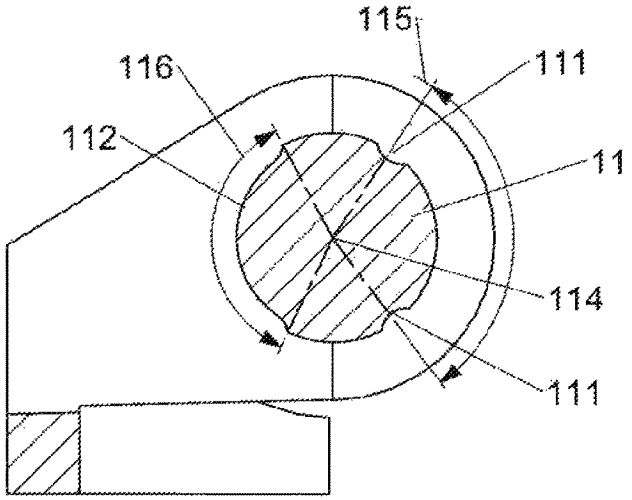
FIG. 5 C-C
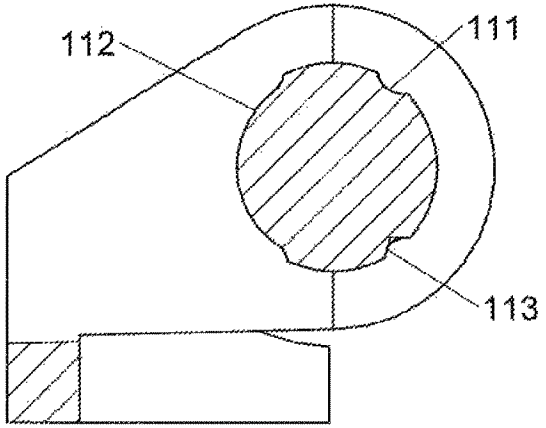
FIG. 6 D-D

TOOL RACK STRUCTURE

BACKGROUND OF THE INVENTION

1. Field of the Invention

The present invention relates to a rack or holder and, more particularly, to a tool rack structure.

2. Description of the Related Art

A conventional tool rack structure was disclosed in the U.S. Pat. No. 5,313,181, and comprises a molded tray 12 in combination with a first pole piece, armature, or keeper 14, a bar magnet 16, a second pole piece, armature, or keeper 18 and a second bar magnet 20. The tray 12 includes a series of parallel troughs 22 which are separated by ridges 24 and extend transversely from a molded, hollow center rib 26. Each trough 22 is sized to receive magnetizable sockets having a range of dimension and shape.

However, the conventional tool rack structure has the following disadvantages.

1. The troughs 22 are only used to receive the sockets so that the troughs 22, and the tray 12 does not have an angle adjusting function, thereby limiting the versatility of the conventional tool rack structure.

2. the troughs 22 cannot position the sockets exactly when the sockets are received in the troughs 22, so that the sockets are easily detached from the troughs 22 inadvertently, thereby causing inconvenience to the operator.

BRIEF SUMMARY OF THE INVENTION

In accordance with the present invention, there is provided a tool rack structure comprising a first body, and a second body pivotally connected with the first body and rotatable relative to the first body. The first body has an end provided with at least one first pivot portion. The at least one first pivot portion is provided with two first locking portions, a second locking portion, and a third locking portion. The second body is provided with at least one third pivot portion pivotally connected with the at least one first pivot portion. The at least one third pivot portion is provided with two fourth locking portions locked onto the two first locking portions, and a fifth locking portion locked onto the third locking portion.

According to the primary advantage of the present invention, the two first locking portions, the second locking portion, and the third locking portion are locked with the two fourth locking portions and the fifth locking portion respectively, so that the second body is positioned at predetermined angles relative to the first body, and the at least one third pivot portion is not detached from the at least one first pivot portion easily.

According to the secondary advantage of the present invention, the two first locking portions and the third locking portion have different structures, while the two fourth locking portions and the fifth locking portion have different structures. In such a manner, the two fourth locking portions and the two first locking portions are used to control the positioning angles between the second body and the first body, while the fifth locking portion and the third locking portion are used to avoid the at least one third pivot portion from being detached from the at least one first pivot portion. Thus, the two fourth locking portions cooperate with the two first locking portions, while the fifth locking portion cooperates with the third locking portion to provide different functions.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

FIG. 4 is a rear view of a first body of the tool rack structure in accordance with the preferred embodiment of the present invention.

FIG. 5 is a cross-sectional view of the first body of the tool rack structure taken along line C-C as shown in FIG. 4.

FIG. 6 is a cross-sectional view of the first body of the tool rack structure taken along line D-D as shown in FIG. 4.

DETAILED DESCRIPTION OF THE INVENTION

Figure 2:
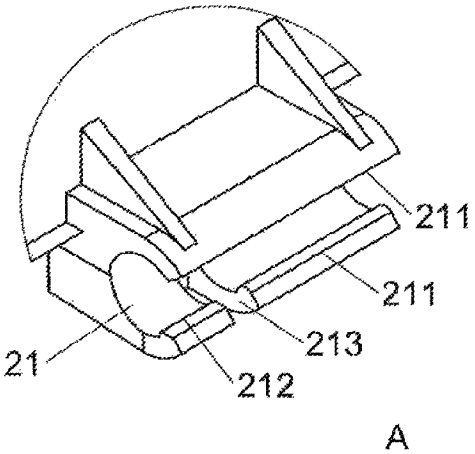
FIG. 2 is an enlarged view of the tool rack structure taken along a mark A as shown in FIG. 1.
Figure 1:
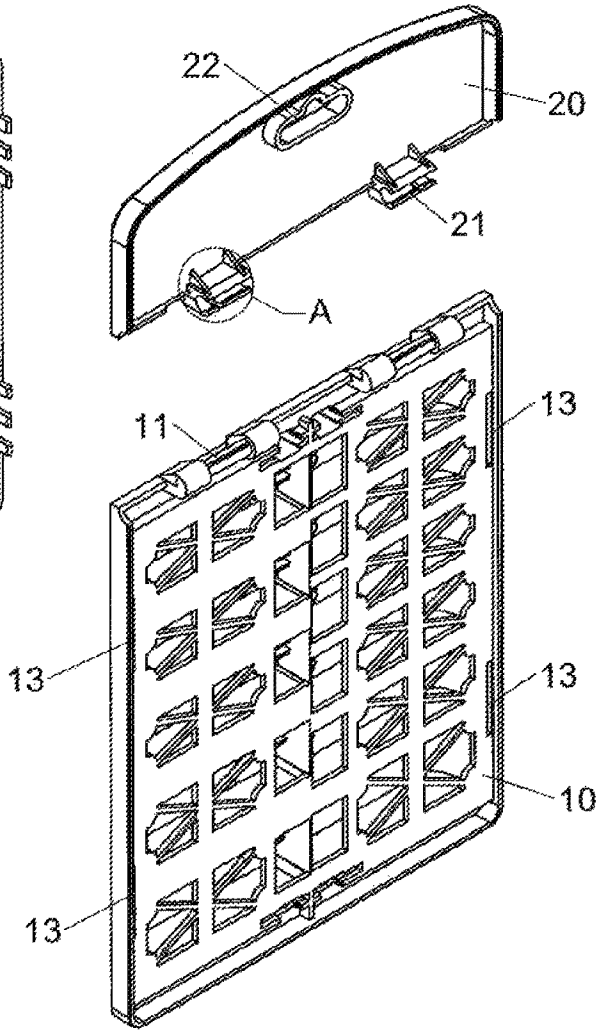
FIG. 1 is an exploded perspective view of a tool rack structure in accordance with the preferred embodiment of the present invention.
Figure 3:
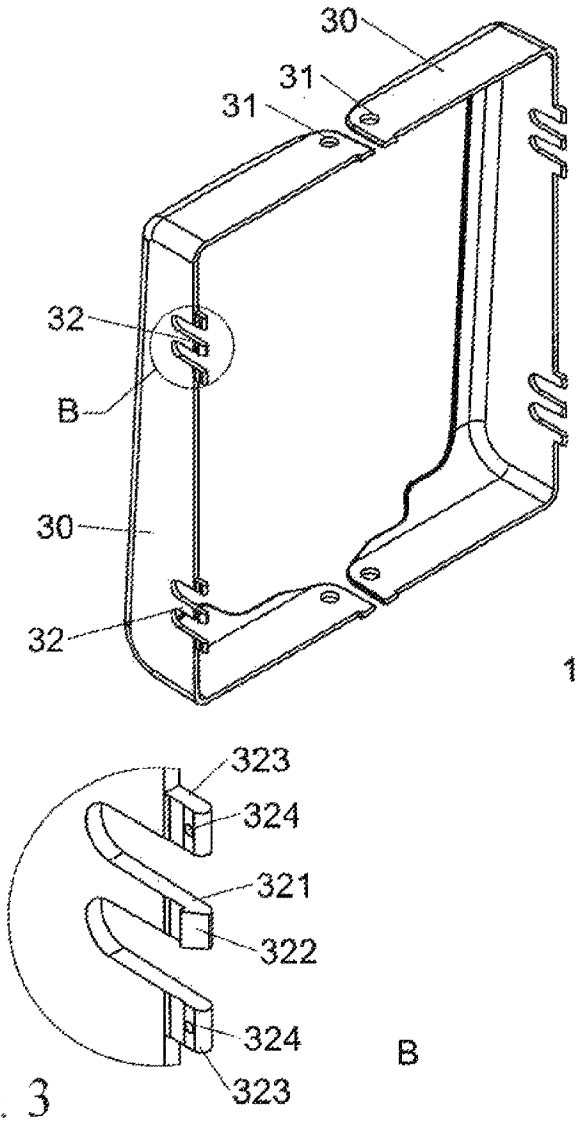
FIG. 3 is an enlarged view of the tool rack structure taken along a mark B as shown in FIG. 1.
Figure 8:
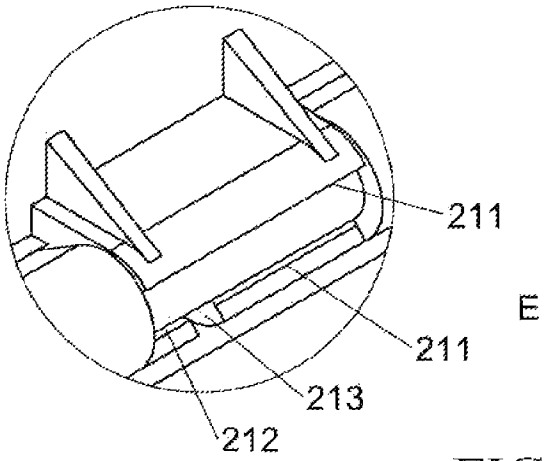
FIG. 8 is an enlarged view of the tool rack structure taken along a mark E as shown in FIG. 7.

Referring to the drawings and initially to FIGS. 1-12, a tool rack structure in accordance with the preferred embodiment of the present invention comprises a first body 10, a second body 20, and at least one third body 30.

The first body 10 has a cuboid shape and has an end provided with at least one first pivot portion 11. The at least one first pivot portion 11 has a cylindrical shape and slightly protrudes from the first body 10. The at least one first pivot portion 11 is provided with two first locking portions 111 (FIG. 5) extending in a lengthwise direction of the at least one first pivot portion 11. Each of the two first locking portions 111 is a concave groove. The at least one first pivot portion 11 is provided with a second locking portion 112 (FIG. 5) extending in the lengthwise direction of the at least one first pivot portion 11. The second locking portion 112 is an elongate channel. The at least one first pivot portion 11 is provided with a third locking portion 113 (FIG. 6). The third locking portion 113 is arranged beside one of the two first locking portions 111. Preferably, the third locking portion 113 is a triangular groove in cross section.

In the preferred embodiment of the present invention, the first body 10 has two first pivot portions 11 spaced from each other and arranged symmetrically relative to the first body 10. Thus, one of the two first pivot portions 11 has the two first locking portions 111 and the third locking portion 113, while the other one of the two first pivot portions 11 only has the two first locking portions 111 without the third locking portion 113.

The at least one first pivot portion 11 has a first axis 114 (FIG. 5). The two first locking portions 111 define a first angle 115 relative to the first axis 114. Preferably, the first angle 115 is at least 90° or 100°, or approximates 110°. The second locking portion 112 defines a second angle 116 relative to the first axis 114. Preferably, the second angle 116 is at least 90° or 110°, or approximates 126°.

The first body 10 is provided with a plurality of second pivot portions 12 (FIG. 4). Each of the second pivot portions 12 is a column or a cylinder. Preferably, The first body 10 is provided with four second pivot portions 12, wherein two of the four second pivot portions 12 are formed on an upper end of the first body 10 and arranged between the two first pivot portions 11, and the other two of the four second pivot portions 12 are formed on a lower end of the first body 10.

The first body 10 is provided with a plurality of first snap-fit portions 13 arranged at two sides of the first body 10. Each of the first snap-fit portions 13 is an elongate slot. Preferably, the first body 10 has four first snap-fit portions 13. The first body 10 is provided with a plurality of mounting portions 14. Each of the mounting portions 14 has a column shape and is used for mounting a tool element (such as a socket or a connector) with a square recess. The mounting portions 14 are arranged in a linear matrix. Preferably, the first body 10 has eleven mounting portions 14.

The second body 20 is pivotally connected with the first body 10 and is rotatable relative to the first body 10. The second body 20 is positioned at three relative angles when the second body 20 is rotated relative to the first body 10. The second body 20 is provided with at least one third pivot portion 21 pivotally connected with the at least one first pivot portion 11. The at least one third pivot portion 21 has a number equal to that of the at least one first pivot portion 11. The at least one third pivot portion 21 is provided with two fourth locking portions 211 (FIG. 2) corresponding to the two first locking portions 111. The two fourth locking portions 211 extend in a lengthwise direction of the at least one third pivot portion 21 and have a shape corresponding to that of the two first locking portions 111. Each of the two fourth locking portions 211 is a convex projection. The two fourth locking portions 211 are arranged at two ends of the at least one third pivot portion 21. The at least one third pivot portion 21 is provided with a fifth locking portion 212 corresponding to the third locking portion 113. The fifth locking portion 212 is arranged beside one of the two fourth locking portions 211 as shown in FIG. 2. The fifth locking portion 212 has a shape and a length corresponding to that of the third locking portion 113. Preferably, the fifth locking portion 212 is a triangular projection in cross section. The at least one third pivot portion 21 is provided with a slit 213 arranged between the two fourth locking portions 211 and the fifth locking portion 212. The second body 20 is provided with a hanging hole 22 having an elongate shape.

In the preferred embodiment of the present invention, the second body 20 has two third pivot portions 21 spaced from each other and arranged symmetrically relative to the second body 20. Thus, one of the two third pivot portions 21 has the two fourth locking portions 211 and the fifth locking portion 212, while the other one of the two third pivot portions 21 only has the two fourth locking portions 211 without the third locking portion 113.

In the preferred embodiment of the present invention, the two first locking portions 111 and the third locking portion 113 have different structures, while the two fourth locking portions 211 and the fifth locking portion 212 have different structures. Thus, the two fourth locking portions 211 and the two first locking portions 111 are used to control the positioning angles between the second body 20 and the first body 10, while the fifth locking portion 212 and the third locking portion 113 are used to avoid the at least one third pivot portion 21 from being detached from the at least one first pivot portion 11.

Figure 9:
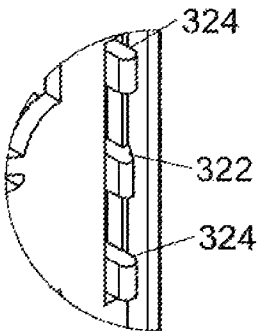
FIG. 9 is an enlarged view of the tool rack structure taken along a mark F as shown in FIG. 7.
Figure 7:
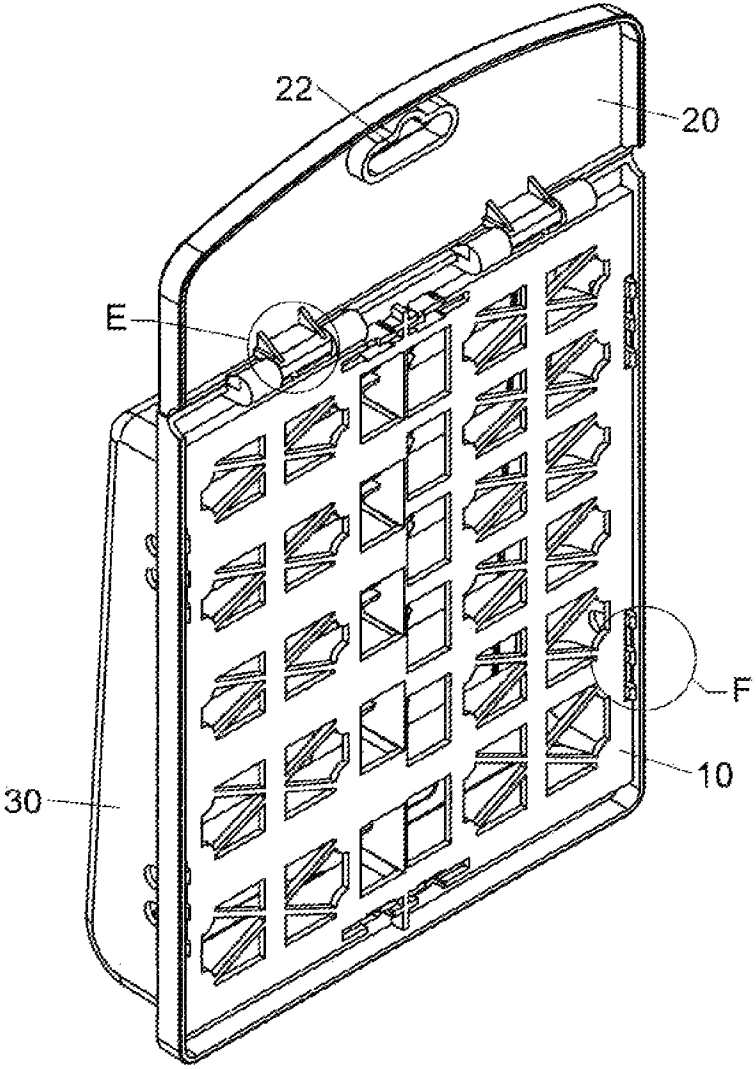
FIG. 7 is a perspective view of the tool rack structure in accordance with the preferred embodiment of the present invention.
Figure 10:
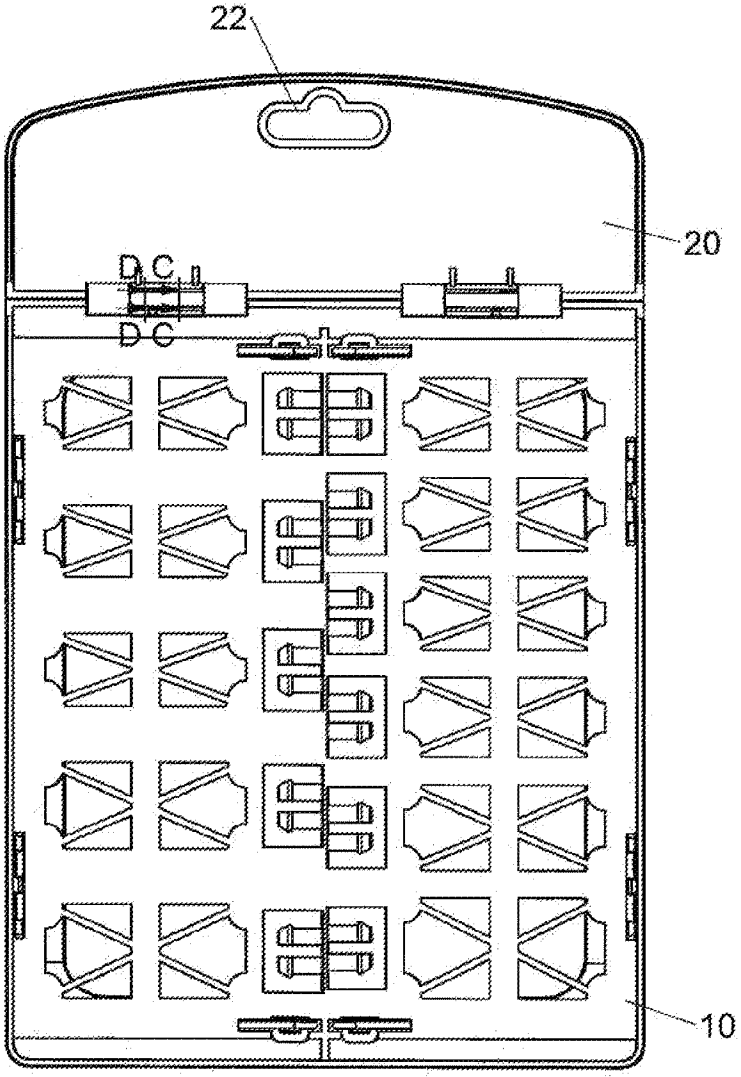
FIG. 10 is a rear view showing a first operation mode of the tool rack structure in accordance with the preferred embodiment of the present invention.
Figure 11:
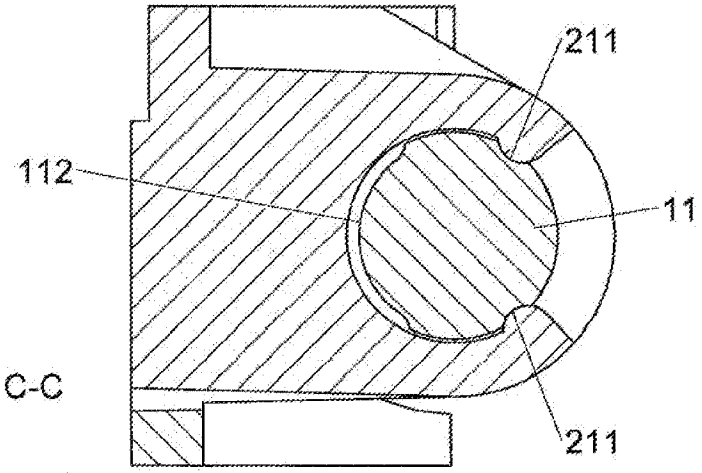
FIG. 11 is a cross-sectional view of the first body of the tool rack structure taken along line C-C as shown in FIG. 10.
Figure 12:
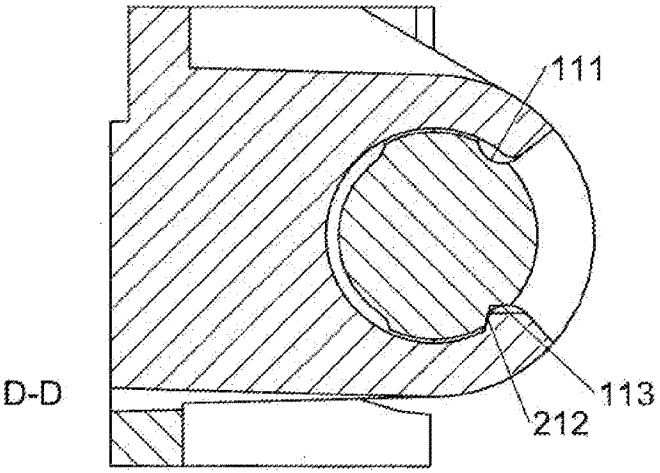
FIG. 12 is a cross-sectional view of the first body of the tool rack structure taken along line D-D as shown in FIG. 10.

Referring to FIGS. 10-12 with reference to FIGS. 1-9, the second locking portion 112 is hidden in each of the two third pivot portions 21 as shown in FIG. 11. The two fourth locking portions 211 are locked onto the two first locking portions 111. The fifth locking portion 212 is locked onto the third locking portion 113 as shown in FIG. 12. The two fourth locking portions 211 are limited by the two first locking portions 111, so that the second body 20 is positioned relative to the first body 10 at three different angles. An angle of 180° is defined between the first body 10 and the second body 20 when the first body 10 is in line with the second body 20.

Multiple tool elements are mounted on the first body 10 so that when the hanging hole 22 is hung on an article, the tool rack structure has a heavy weight. At this time, the fifth locking portion 212 is locked onto the third locking portion 113, to prevent the at least one third pivot portion 21 from being released from the at least one first pivot portion 11, and to prevent the second body 20 from being detached from the first body 10. In addition, the direction of gravity of the first body 10 applied on the second body 20 is perpendicular to that of the fifth locking portion 212 locked with the third locking portion 113, to prevent the second body 20 from being detached from the first body 10.

Figure 13:
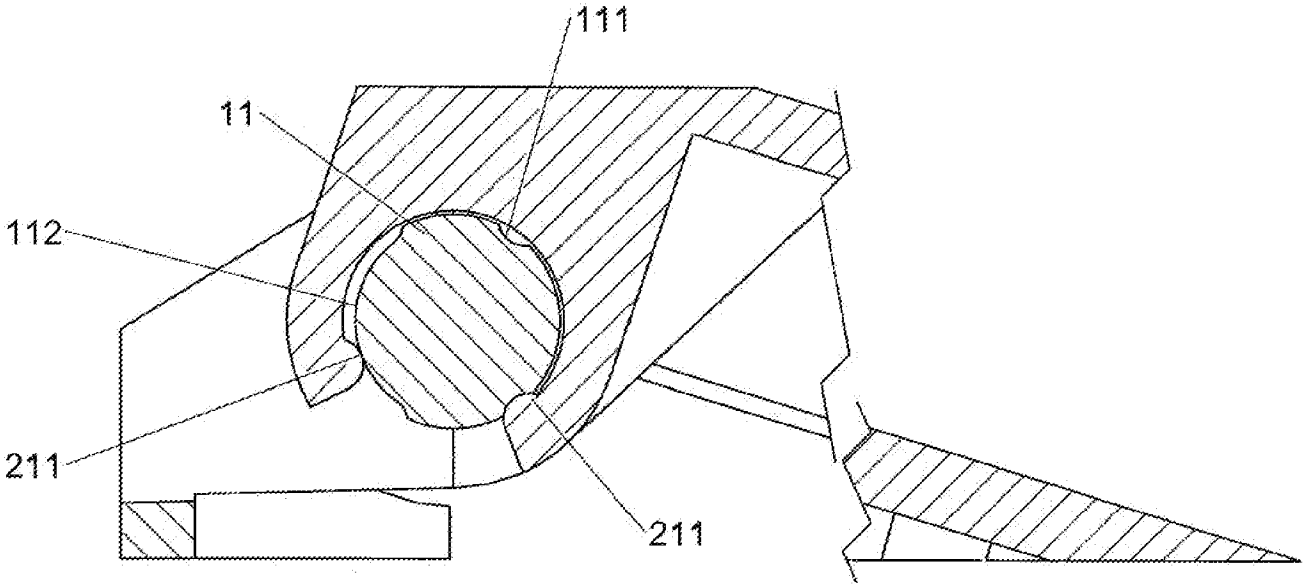
FIG. 13 is a cross-sectional view showing a second operation mode of the tool rack structure in accordance with the preferred embodiment of the present invention.
Figure 14:
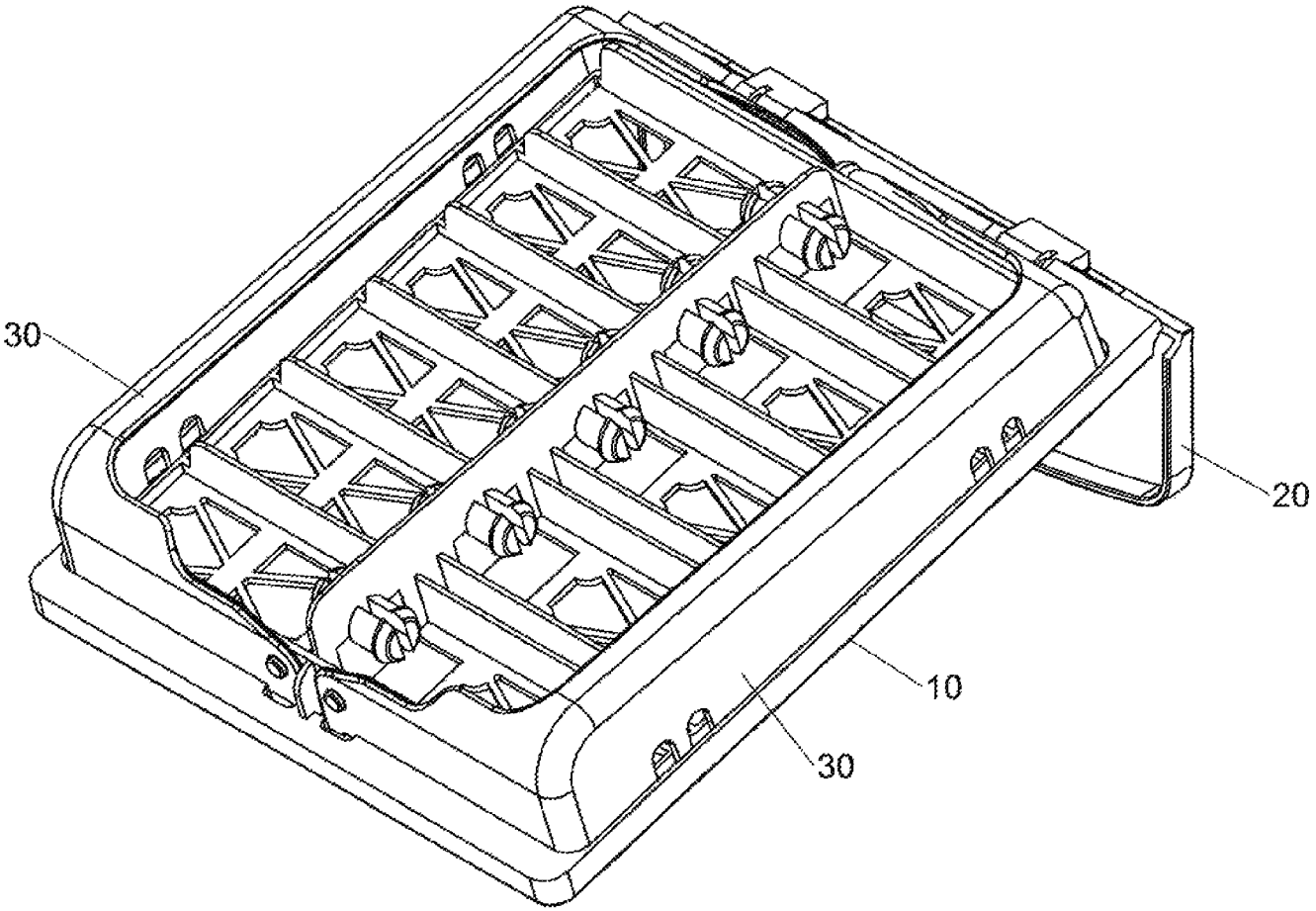
FIG. 14 is a perspective view showing the second operation mode of the tool rack structure in accordance with the preferred embodiment of the present invention.

Referring to FIGS. 13 and 14 with reference to FIGS. 1-12, when the second body 20 is rotated relative to the first body 10 through an angle, one of the two first locking portions 111 is hidden in the at least one third pivot portion 21, the other one of the two first locking portions 111 is locked with one of the two fourth locking portions 211, and the other one of the two fourth locking portions 211 is received in the second locking portion 112, so that the second body 20 is positioned on the first body 10. Thus, the first body 10 and the second body 20 are disposed at an inclined state to facilitate a user taking out the tool elements on the mounting portions 14.

Figure 15:
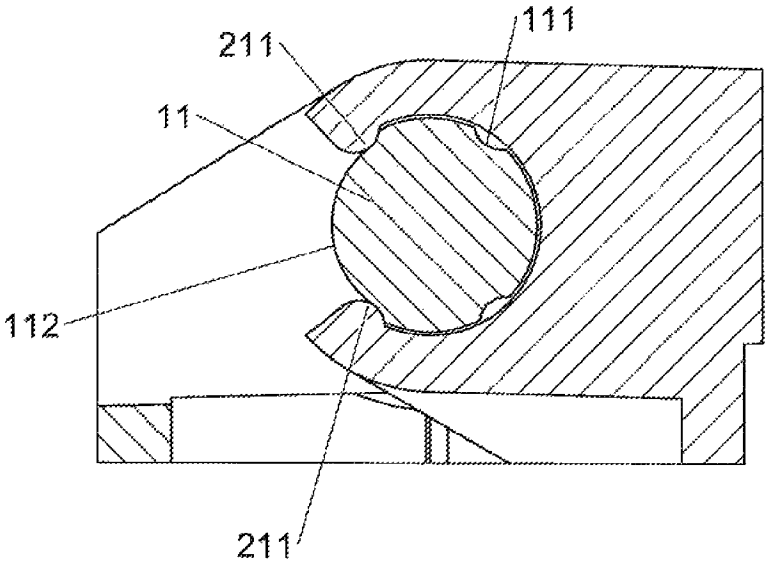
FIG. 15 is a cross-sectional view showing a third operation mode of the tool rack structure in accordance with the preferred embodiment of the present invention.

Referring to FIG. 15 with reference to FIGS. 1-14, when the second body 20 is further rotated relative to the first body 10 through an angle, the two first locking portions 111 is hidden in the at least one third pivot portion 21, and the two fourth locking portions 211 are locked on two ends of the second locking portion 112, so that the second body 20 is positioned on the first body 10. Thus, the second body 20 is folded relative to the first body 10 to facilitate the user storing the tool rack structure.

Again referring to FIGS. 1-9, the at least one third body 30 is provided with a plurality of fourth pivot portions 31 pivotally connected with the second pivot portions 12. The at least one third body 30 is provided with a plurality of second snap-fit portions 32 detachably fitted with the first snap-fit portions 13. Each of the second snap-fit portions 32 is provided with a first retaining element 321 and two second retaining elements 323. The first retaining element 321 is arranged between the two second retaining elements 323. The first retaining element 321 is an elongate projection and has a distal end provided with a first locking tenon 322 having a triangular shape. Each of the two second retaining elements 323 is an elongate projection and has a distal end provided with a second locking tenon 324 having a semi-circular shape.

In the preferred embodiment of the present invention, the tool rack structure has two third bodies 30. Each of the two third bodies 30 is a U-shaped bracket and has two fourth pivot portions 31 and two second snap-fit portions 32.

When each of the second snap-fit portions 32 is fitted onto each of the first snap-fit portions 13, the first retaining element 321 and the two second retaining elements 323 extend through each of the first snap-fit portions 13, and the first locking tenon 322 and the second locking tenon 324 protrude from and are locked onto each of the first snap-fit portions 13 as shown in FIG. 9. The first body 10 is retained by the first locking tenon 322 so that the first retaining element 321 is secured to the first body 10, and the at least one third body 30 is secured to and will not be detached from the first body 10. After the first locking tenon 322 is cut, each of the two second retaining elements 323 is easily detached from each of the first snap-fit portions 13 by provision of the second locking tenon 324, so that each of the second snap-fit portions 32 is detached from each of the first snap-fit portions 13, and the at least one third body 30 is rotatable relative to the first body 10.

In assembly, referring to FIGS. 7-12 with reference to FIGS. 1-6, the at least one third pivot portion 21 is pivotally connected with the at least one first pivot portion 11, so that the second body 20 is pivotally connected with the first body 10. The fourth pivot portions 31 are pivotally connected with the second pivot portions 12, the second snap-fit portions 32 are assembled with the first snap-fit portions 13, the first retaining element 321 and the two second retaining elements 323 extend through each of the first snap-fit portions 13, and the first locking tenon 322 and the second locking tenon 324 protrude from and are locked onto each of the first snap-fit portions 13, so that the at least one third body 30 is secured to and will not be detached from the first body 10.

As shown in FIGS. 10-12, the first body 10 is in line with the second body 20, with an angle of 180° being defined between the first body 10 and the second body 20.

As shown in FIGS. 13 and 14, one of the two first locking portions 111 is locked with one of the two fourth locking portions 211, so that the second body 20 is positioned at a determined angle. Thus, the first body 10 is disposed at an inclined state to facilitate a user taking out the tool elements on the mounting portions 14.

As shown in FIG. 15, the two fourth locking portions 211 are locked on two ends of the second locking portion 112, so that the second body 20 is positioned on the first body 10 and is folded relative to the first body 10.

Figure 17:
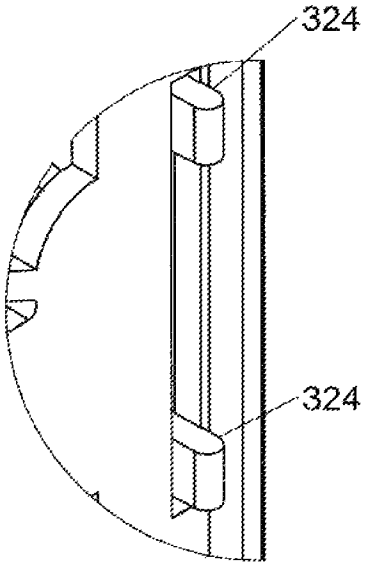
FIG. 17 is an enlarged view of the tool rack structure taken along a mark F as shown in FIG. 16.
Figure 16:
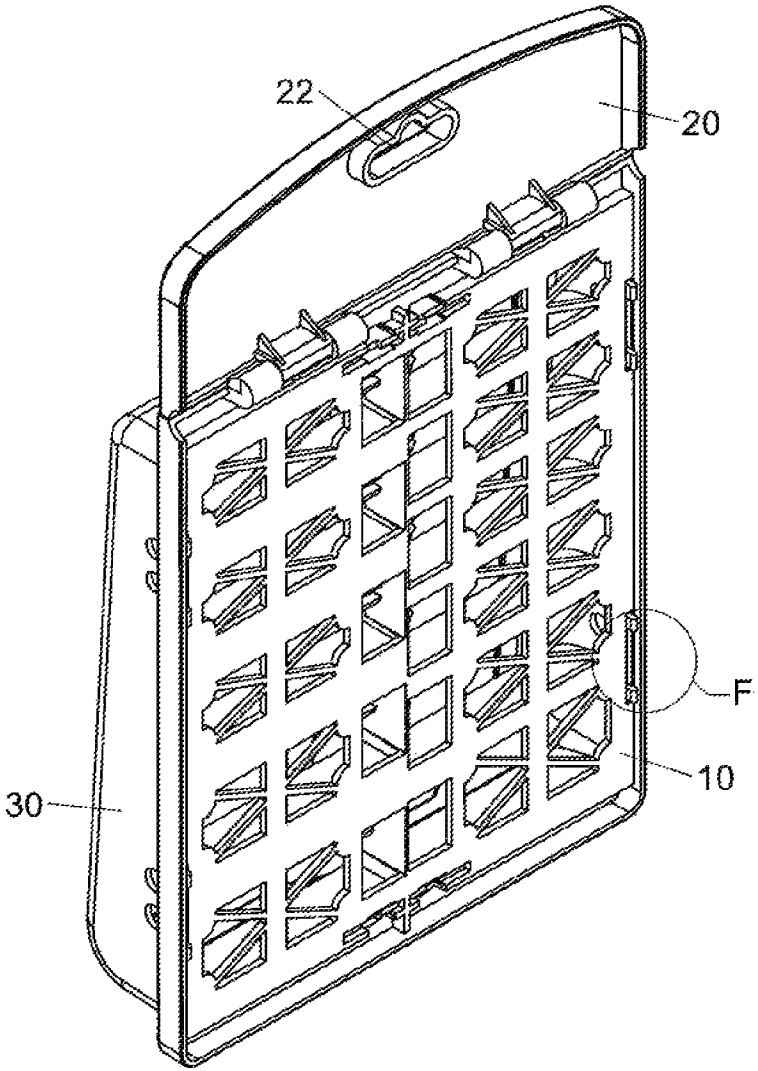
FIG. 16 is a perspective view showing a fourth operation mode of the tool rack structure in accordance with the preferred embodiment of the present invention.
Figure 18:
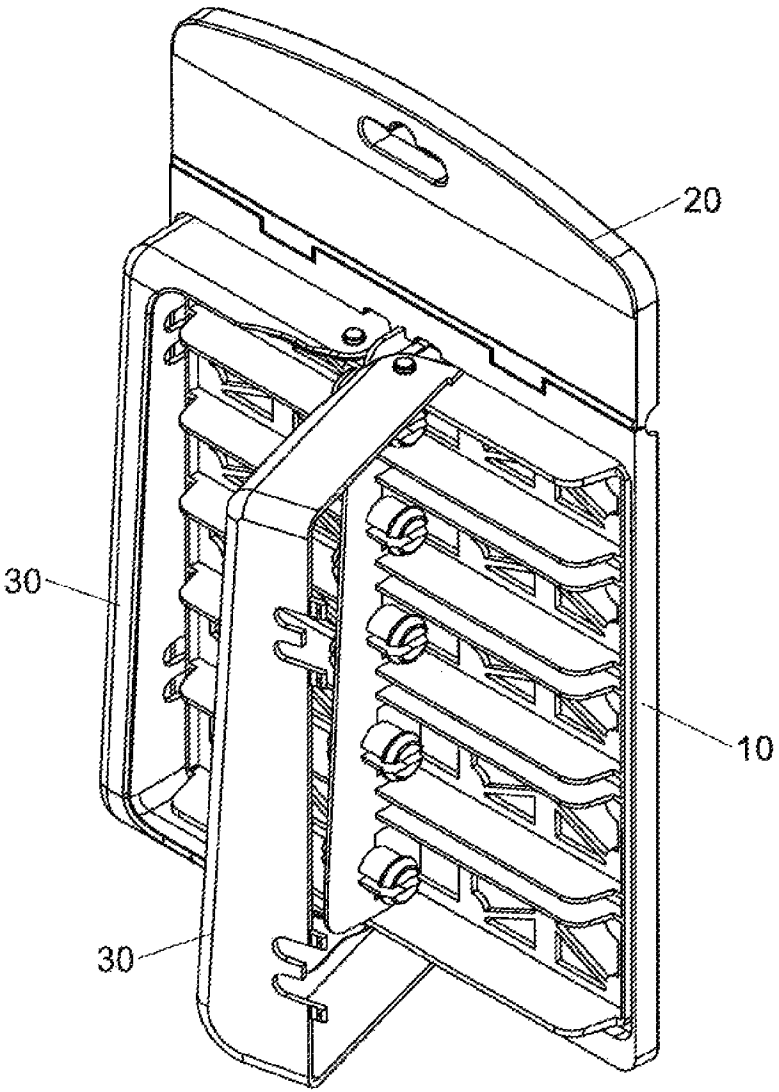
FIG. 18 is a perspective view showing a fifth operation mode of the tool rack structure in accordance with the preferred embodiment of the present invention.

Referring to FIGS. 16-18, after the first locking tenon 322 is cut, the second locking tenon 324 is released from each of the first snap-fit portions 13 easily, so that the two second retaining elements 323 are detached from each of the first snap-fit portions 13 easily. Thus, each of the second snap-fit portions 32 is detached from each of the first snap-fit portions 13, and the at least one third body 30 is unlocked from the first body 10 and is rotatable relative to the first body 10 as shown in FIG. 18.

Figure 19:
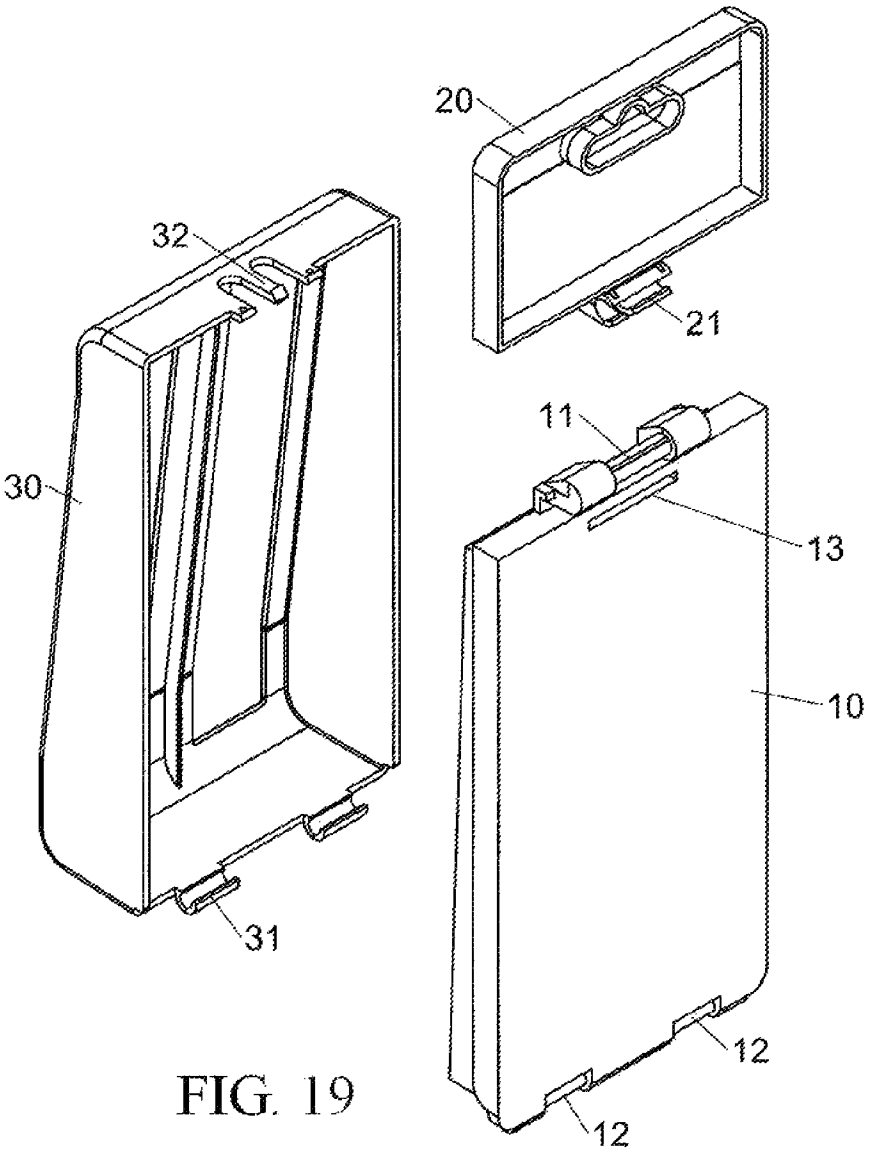
FIG. 19 is an exploded perspective view of a tool rack structure in accordance with another preferred embodiment of the present invention.
Figure 20:
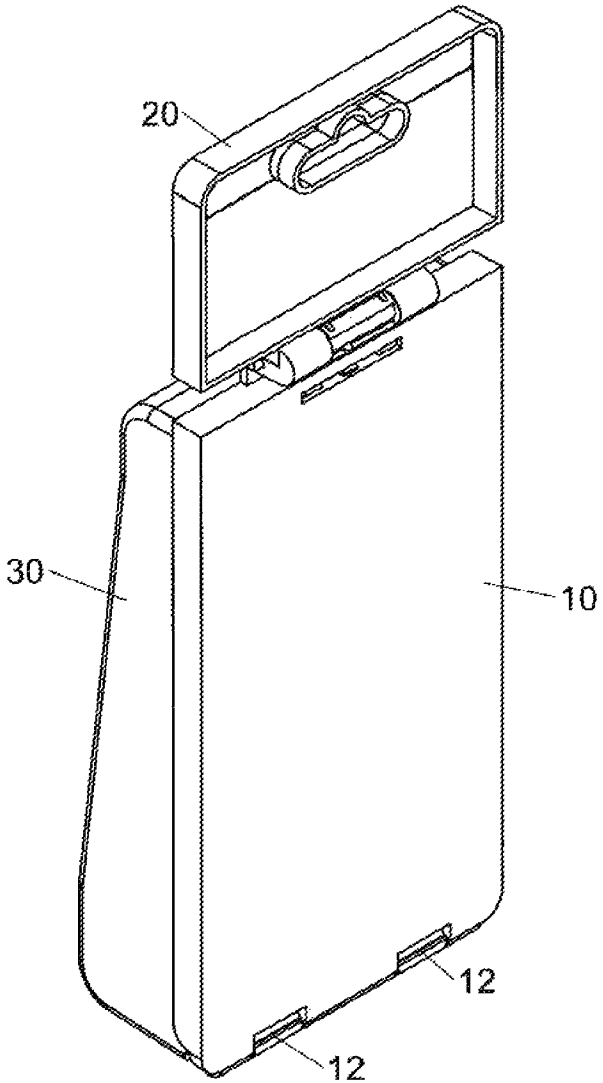
FIG. 20 is a perspective assembly view of the tool rack structure as shown in FIG. 19.

Referring to FIGS. 19 and 20, the first body 10 has a first pivot portion 11, two second pivot portions 12, and a first snap-fit portion 13. The two second pivot portions 12 are formed on a lower end of the first body 10. The first snap-fit portion 13 is close to the first pivot portion 11. The second body 20 has a third pivot portion 21. The tool rack structure has a third body 30. The third body 30 has two fourth pivot portions 31 and a second snap-fit portion 32. The two fourth pivot portions 31 are formed on a lower end of the third body 30. The second snap-fit portion 32 is formed on an upper end of the third body 30. The second snap-fit portion 32 is detachably fitted with the first snap-fit portion 13.

Accordingly, the tool rack structure has the following advantages.

1. The two first locking portions 111, the second locking portion 112, and the third locking portion 113 are locked with the two fourth locking portions 211 and the fifth locking portion 212 respectively, so that the second body 20 is positioned at predetermined angles relative to the first body 10, and the at least one third pivot portion 21 is not detached from the at least one first pivot portion 11 easily.

2. The second body 20 is rotated relative to the first body 10 through three different angles.

3. The two first locking portions 111 and the third locking portion 113 have different structures, while the two fourth locking portions 211 and the fifth locking portion 212 have different structures. In such a manner, the two fourth locking portions 211 and the two first locking portions 111 are used to control the positioning angles between the second body 20 and the first body 10, while the fifth locking portion 212 and the third locking portion 113 are used to avoid the at least one third pivot portion 21 from being detached from the at least one first pivot portion 11. Thus, the two fourth locking portions 211 cooperate with the two first locking portions 111, while the fifth locking portion 212 cooperates with the third locking portion 113 to provide different functions.

4. The two fourth locking portions 211 cooperate with the two first locking portions 111 to position the second body 20 on the first body 10, and to prevent the second body 20 from being detached from the first body 10.

5. As shown in FIGS. 13 and 14, when the second body 20 is rotated relative to the first body 10 through an angle, one of the two first locking portions 111 is hidden in the at least one third pivot portion 21, the other one of the two first locking portions 111 is locked with one of the two fourth locking portions 211, and the other one of the two fourth locking portions 211 is received in the second locking portion 112, so that the second body 20 is positioned on the first body 10 with an angle defined therebetween. Thus, the first body 10 and the second body 20 are disposed at an inclined state to facilitate the user taking out the tool elements on the mounting portions 14.

6. As shown in FIG. 15, the two fourth locking portions 211 are locked on two ends of the second locking portion 112, so that the second body 20 is positioned on the first body 10 by locking of the second locking portion 112 and is folded relative to the first body 10 to facilitate the user storing the tool rack structure.

7. As shown in FIGS. 16-18, after the first locking tenon 322 is cut, each of the second snap-fit portions 32 is detached from each of the first snap-fit portions 13, and the at least one third body 30 is unlocked and removed from the first body 10 so that the user can use the tool elements on the mounting portions 14.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A tool rack structure comprising:

a first body, a second body, and at least one third body; wherein:

the first body has an end provided with at least one first pivot portion;

the at least one first pivot portion is provided with two first locking portions extending in a lengthwise direction of the at least one first pivot portion;

each of the two first locking portions is a concave groove;

the at least one first pivot portion is provided with a second locking portion extending in the lengthwise direction of the at least one first pivot portion;

the second locking portion is an elongate channel;

the at least one first pivot portion is provided with a third locking portion;

the third locking portion is a triangular groove in cross section;

the first body is provided with a plurality of second pivot portions;

the first body is provided with a plurality of first snap-fit portions;

each of the first snap-fit portions is an elongate slot;

the first body is provided with a plurality of mounting portions;

the second body is pivotally connected with the first body and is rotatable relative to the first body;

the second body is positioned at three relative angles when the second body is rotated relative to the first body;

the second body is provided with at least one third pivot portion pivotally connected with the at least one first pivot portion;

the at least one third pivot portion is provided with two fourth locking portions corresponding to the two first locking portions;

the two fourth locking portions extend in a lengthwise direction of the at least one third pivot portion;

each of the two fourth locking portions is a convex projection;

the at least one third pivot portion is provided with a fifth locking portion corresponding to the third locking portion;

the fifth locking portion is a triangular projection in cross section;

the at least one third pivot portion is provided with a slit arranged between the two fourth locking portions and the fifth locking portion;

the two fourth locking portions and the two first locking portions control positioning angles between the second body and the first body, while the fifth locking portion and the third locking portion avoid the at least one third pivot portion from being detached from the at least one first pivot portion;

the second locking portion is hidden in each of the two third pivot portions;

the two fourth locking portions are locked onto the two first locking portions;

the fifth locking portion is locked onto the third locking portion;

the two fourth locking portions are limited by the two first locking portions, so that the second body is positioned relative to the first body at three different angles;

an angle of 180° is defined between the first body and the second body when the first body is in line with the second body;

when the second body is rotated relative to the first body through an angle, one of the two first locking portions is hidden in the at least one third pivot portion, the other one of the two first locking portions is locked with one of the two fourth locking portions, and the other one of the two fourth locking portions is received in the second locking portion, so that the second body is positioned on the first body;

when the second body is further rotated relative to the first body through an angle, the two first locking portions is hidden in the at least one third pivot portion, and the two fourth locking portions are locked on two ends of the second locking portion, so that the second body is positioned on the first body;

the at least one third body is provided with a plurality of fourth pivot portions pivotally connected with the second pivot portions; and the at least one third body is provided with a plurality of second snap-fit portions detachably fitted with the first snap-fit portions.

2. The tool rack structure as claimed in claim 1, wherein:

the first body has a cuboid shape;

the first body has two first pivot portions spaced from each other and arranged symmetrically relative to the first body; and one of the two first pivot portions has the two first locking portions and the third locking portion, while the other one of the two first pivot portions only has the two first locking portions.

3. The tool rack structure as claimed in claim 1, wherein:

the at least one first pivot portion has a first axis;

the two first locking portions define a first angle relative to the first axis;

the first angle is at least 90° or 100°, or approximates 110°;

the second locking portion defines a second angle relative to the first axis; and the second angle is at least 90° or 110°, or approximates 126°.

4. The tool rack structure as claimed in claim 2, wherein:

each of the second pivot portions is a column;

the first body is provided with four second pivot portions;

two of the four second pivot portions are formed on an upper end of the first body and arranged between the two first pivot portions, and the other two of the four second pivot portions are formed on a lower end of the first body;

the first body has four first snap-fit portions;

the tool rack structure has two third bodies;

each of the two third bodies has two fourth pivot portions and two second snap-fit portions;

each of the second snap-fit portions is provided with a first retaining element and two second retaining elements;

the first retaining element is arranged between the two second retaining elements;

the first retaining element is an elongate projection and has a distal end provided with a first locking tenon having a triangular shape;

each of the two second retaining elements is an elongate projection and has a distal end provided with a second locking tenon having a semi-circular shape;

when each of the second snap-fit portions is fitted onto each of the first snap-fit portions, the first retaining element and the two second retaining elements extend through each of the first snap-fit portions, and the first locking tenon and the second locking tenon protrude from and are locked onto each of the first snap-fit portions;

the first body is retained by the first locking tenon so that the first retaining element is secured to the first body, and the at least one third body is secured to the first body; and after the first locking tenon is cut, each of the two second retaining elements is detached from each of the first snap-fit portions, so that each of the second snap-fit portions is detached from each of the first snap-fit portions, and the at least one third body is rotatable relative to the first body.

5. The tool rack structure as claimed in claim 1, wherein the mounting portions are arranged in a linear matrix, the first body has eleven mounting portions, and each of the mounting portions has a column shape.

6. The tool rack structure as claimed in claim 2, wherein the at least one third pivot portion has a number equal to that of the at least one first pivot portion, the second body has two third pivot portions spaced from each other and arranged symmetrically relative to the second body, and one of the two third pivot portions has the two fourth locking portions and the fifth locking portion, while the other one of the two third pivot portions only has the two fourth locking portions.

7. The tool rack structure as claimed in claim 1, wherein the second body is provided with a hanging hole having an elongate shape, and the fifth locking portion is locked onto the third locking portion, to prevent the at least one third pivot portion from being released from the at least one first pivot portion, and to prevent the second body from being detached from the first body.

8. The tool rack structure as claimed in claim 1, wherein:

the first body has a first pivot portion, two second pivot portions, and a first snap-fit portion;

the two second pivot portions are formed on a lower end of the first body;

the first snap-fit portion is close to the first pivot portion;

the second body has a third pivot portion;

the tool rack structure has a third body;

the third body has two fourth pivot portions and a second snap-fit portion;

the two fourth pivot portions are formed on a lower end of the third body;

the second snap-fit portion is formed on an upper end of the third body; and the second snap-fit portion is detachably fitted with the first snap-fit portion.

* * * * *